US010525321B1

(12) United States Patent
Kvale

(10) Patent No.: US 10,525,321 B1
(45) Date of Patent: Jan. 7, 2020

(54) GOLF RING TRAINING DEVICE AND METHOD

(71) Applicant: John Jay Kvale, Redding, CA (US)

(72) Inventor: John Jay Kvale, Redding, CA (US)

( * ) Notice: Subject to any disclaimer, the term of this patent is extended or adjusted under 35 U.S.C. 154(b) by 0 days.

(21) Appl. No.: 16/444,536

(22) Filed: Jun. 18, 2019

(51) Int. Cl.
*A63B 69/36* (2006.01)

(52) U.S. Cl.
CPC ..... *A63B 69/3623* (2013.01)

(58) Field of Classification Search
CPC . A63B 69/3676; A63B 2102/32; A63B 69/36; A63B 69/00; A63B 2053/0495; A63B 2069/402; A63B 69/3623
USPC ..... 473/179–181, 185–189, 162, 200, 220, 473/280, 281, 351, 409, 588, 589, 595
See application file for complete search history.

(56) References Cited

U.S. PATENT DOCUMENTS 7,134,979 B2 11/2006 Edwards
7,140,971 B2 * 11/2006 Trudeau ..... A63B 47/02 473/180
7,300,357 B2 11/2007 Breaker et al.
7,815,532 B2 * 10/2010 Harpell ..... A63B 69/0026 473/588
8,323,120 B2 * 12/2012 Lorenzana ..... A63B 69/3688 473/200
9,649,545 B2 5/2017 Dawe et al.
2003/0162603 A1 * 8/2003 Breaker ..... A63B 43/002 473/280
2008/0300072 A1 * 12/2008 Harpell ..... A63B 67/14 473/446

* cited by examiner

*Primary Examiner* — Nini F Legesse

(57) ABSTRACT

A hollow, angled-cylindrical golf ring training device and method provides feedback on the clubface's starting and follow-through conditions. The participant pivots the device from a resting position into a stationary starting position before performing a follow-through motion. In one embodiment, the training device provides immediate feedback of clubface location and orientation by pivoting from an ellipsoid into a more circular appearance. A participant may then sweep the device accurately into the air to a target by controlling the clubface angle of attack and follow-through alignment. Less optimized conditions cause the training device to slide over or under the clubface without accurately reaching a target in the air or in a tumbling manner. Lofted clubs may be practiced solely with the device, or a ball may be placed on top of the device for use with the driver. Practice may occur independently or in a group game setting.

19 Claims, 5 Drawing Sheets

GOLF RING TRAINING DEVICE AND METHOD

CROSS-REFERENCE TO RELATED APPLICATIONS

Not applicable;

STATEMENT REGARDING FEDERALLY SPONSORED RESEARCH OR DEVELOPMENT

No federal money was used in the research and development of the identified training device or method.

REFERENCE TO SEQUENCE LISTING

Not applicable

BACKGROUND OF THE INVENTION

This invention relates to a golf ring training device and method, with potential application to other stick-based sports such as field and ice hockey.

Golf is a sport played worldwide, by people of varying ages and abilities. Playing regularly is thought to reduce risk factors for cardiovascular disease, type II diabetes, some cancers, depression, and dementia. Despite benefits of regular golf participation, many factors, such as: high cost, access to a course, difficulty learning, lack of fun, fear of being embarrassed, and health concerns may limit regular golf participation. Some authors seeking to describe golf ailments identified overuse and poor technique as common causes of injury.

Although learning a new technique or skill is challenging, it is documented that improvements are possible. Daily practice using slow, controlled motions and an external feedback mechanism are two commonly given strategies to speed the learning process. The author has identified some barriers to regular indoor golf practice, which includes expense, space, reaction forces of projectile striking indoors, setup time, and limited feedback on clubface conditions through impact.

Many existing golf training devices suitable for indoor practice aim to improve golfing ability by providing a person sensory feedback of their golf technique but contain drawbacks. For example, indoor launch monitors or sensor systems may measure ball speed, spin rates, clubhead angle of attack, clubface angle at impact, among other variables, but these systems are costly and require extensive space. Other existing patents of golf training projectiles have drawbacks since they: may occur as solid discs, lack immediate feedback on initial and follow through clubface conditions, utilize a striking or hitting force, require aerodynamics to slow the training device, or require additional expense for use with the driver club. Thus, an inexpensive, quick, and low energy golf ring training device and method which allows a person to practice their golf impact position and clubface control during the follow through motion to a target may facilitate the learning process.

BRIEF SUMMARY OF THE INVENTION

The golf ring training device and method is for a hollow, angled-cylindrical, ring- shaped training device made of a lightweight and resilient material which provides immediate feedback about a participant's clubface control when in the stationary starting position and during the follow through motion. Non-obvious and novel angled characteristics of the training device's hollow cylindrical body when in contact with a golf clubface confine the training device's appearance, airborne trajectory, distance, and accuracy during in use. Lofted golf clubs may be used in this manner with the training device alone and a driver club may be practiced in the same method by placing a golf or other training ball on top of the training device in the resting position. The training device may be used independently or in a group game setting.

The golf ring training device and method provides an opportunity for golf-type practice of impact and follow through clubface control while minimizing potential detrimental effects from projectile striking or hitting indoors. In one embodiment, the training device's cylindrical hollow space and body surfaces appear ellipsoid to the participant's view in the resting position. When the participant pivots the training device with a clubface into the starting position, the device's cylindrical body surfaces approximate a more circular look, thus providing visual and tactile feedback on clubface orientation. Through intended clubface angle of attack and follow through motion control, the participant may sweep the golf ring training device without tumbling through the air, into a small netting or other goal across a room and without touching the operating surface first. In a less optimized clubface starting position or follow through motion control, the golf ring training device may slide over or under the clubface, not acquire enough linear momentum to become airborne, tumble in the air, or may otherwise miss the target. Thus, the golf ring training device and method provides quick and inexpensive access to multiple types of feedback based on a participant's clubface control without reaction forces from projectile striking and without reliance on aerodynamic properties of the device.

DETAILED DESCRIPTION OF THE DRAWINGS

The embodiment described may take other forms without deviating from spirit or scope of this invention.

Figure 1A:
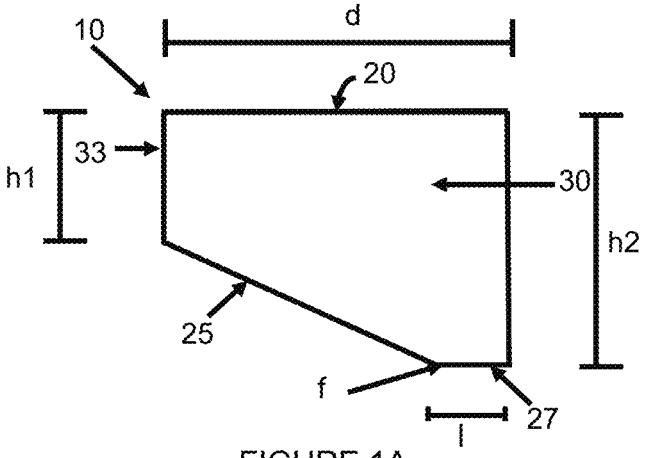
FIG. 1A is a side view of an exemplary embodiment of the golf ring training device
Figure 1B:
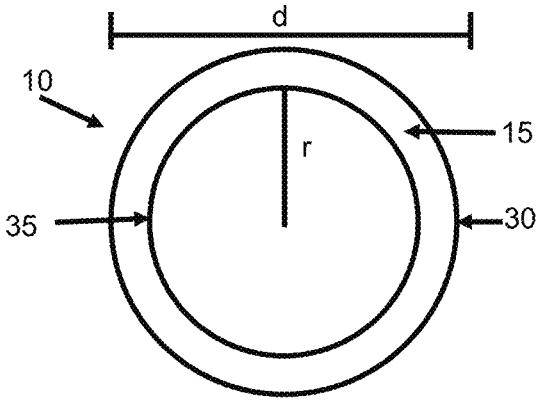
FIG. 1B is a top view of an exemplary embodiment of the golf ring training device when viewed in the starting position
Figure 1C:
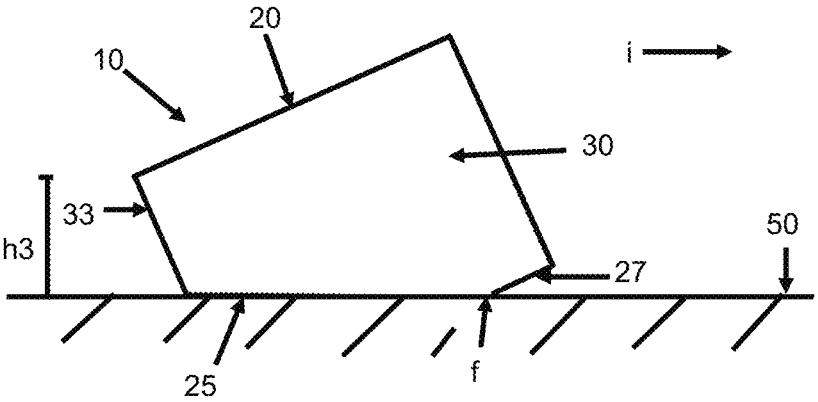
FIG. 1C is a perspective view of an exemplary embodiment of the golf ring training device in the resting position on an operating surface

FIGS. 1A through 1C show various views of the golf ring training device 10 in exemplary embodiment. FIG. 1A is a side view of an exemplary embodiment of the golf ring training device 10. The training device 10 has an external cylindrical body surface 30 which separates the top surface 20 from the bottom rest 25 and tilt 27 surfaces. The diameter of the external cylindrical body surface is marked d, ~1.9" in this embodiment, but may range from 1.3" to 2.6". In the resting position as shown in FIG. 1C, the training device 10 lays on the rest surface 25 such that the external cylindrical body surface angles away from the intended target. The interface between rest 25 and tilt 27 surfaces may be angled, flat or rounded, to create at least 1 pivot point f on the bottom surface at which the cylindrical body pivots. In the event of a flat bottom surface, the pivot f occurs at a junction between the external cylindrical body surface 30 and the rest surface 25 angled closest to the target. In the starting position and during the follow through motion, the cylindrical body tilts perpendicular to an axis about pivot f to engage tilt surface 27. The length of surface 27 from the pivot to the external cylindrical body surface 30 is described by I, 0.6" in this embodiment, but may range from 0 to <1.3". The portion of the external cylindrical body surface 30 angled furthest from the target receives the clubface during use on the contact surface 33. The shortest cylindrical body height, h1, is the smallest distance parallel to the cylindrical body from the resting surface 25 to the top surface 20, and h1 is ~0.8" in this embodiment. The values of h1 may range from approximately half the size of a standard golf ball ~0.8" to 2". The longest cylindrical body height, h2, is the largest distance parallel to the cylindrical body from the tilt surface 27 to the top surface 20, and h2 is 1.4" in this embodiment. The values of h2 may range from >=h1 to <3".

FIG. 1B is a top view of an exemplary embodiment of the golf ring training device 10 when tilted into a starting position. The solid portion of the cylindrical body 15 occurs between the parallel external cylindrical body surface 30 and the internal cylindrical body surface 35. The diameter of the external cylindrical body surface 30 is marked d. The centrically located hollow internal cylindrical space has radius r, ~0.8" in this embodiment. Values of r may range from d/2−0.125" and 0.375". The hollow internal cylindrical space of radius r occurs in conjunction with the internal cylindrical body surface 35. External cylindrical body surface 30, the internal cylindrical body surface 35, and the hollow internal cylindrical space approximate a more circular appearance when the cylindrical body 15 is seen in this starting position.

FIG. 1C shows a side view of an exemplary embodiment of the golf ring training device 10 in the resting position on the external operating surface 50. The external operating surface 50 may be carpet, matting, or other surface with enough friction on the pivot f and tilt surfaces to allow the training device 10 to tilt without sliding into the starting position. The training device 10 has a top surface 20 and a rest surface 25 as previously described. In the resting position, the external cylindrical body surface 30 lays angled away from the intended target direction i. The external cylindrical body surface 30 located furthest from the intended target receives the clubface during use on contact surface 33. To reach the starting position, the golf ring training device 10 is tilted about pivot f toward the tilt surface 27 without sliding on the operating surface 50, as further illustrated in FIG. 4B. In the resting position, the smallest distance from the operating surface 50 to the top surface 20 is marked h3, or ~0.7" in this embodiment. The height of h3 may range from approximately ~0.6" to 1.6".

Figure 2A:
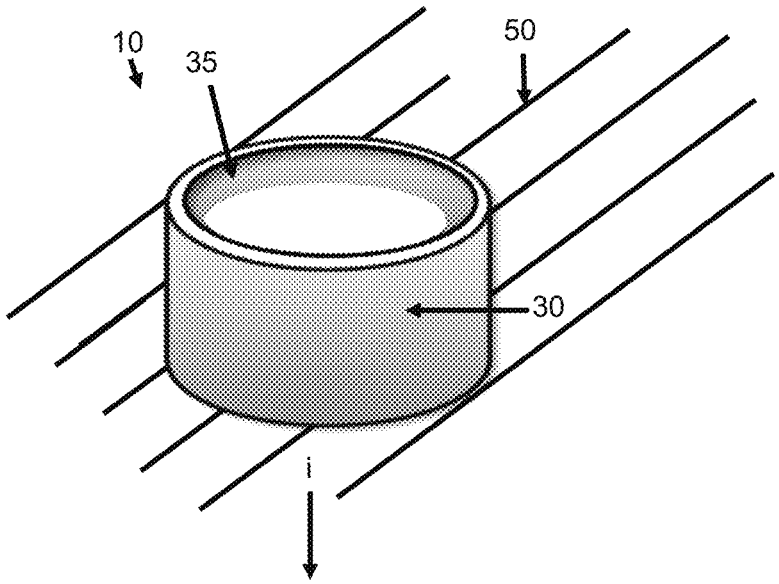
FIG. 2A is a perspective view of an exemplary embodiment of the golf ring training device in the resting position as seen from above.

FIG. 2A shows a perspective view from directly above of an exemplary embodiment of the golf ring training device 10 in resting position angled away from intended target direction i. The external cylindrical body surface 30, the internal cylindrical body surface 35, and the hollow internal cylindrical space approximate an ellipsoid appearance while the training device 10 lays in the resting position on the external operating surface 50. The external cylindrical body surface 30 also appears to have 2 linear sides when viewed from above. When tilted into the starting position, the device approximates FIG. 1B appearance when seen above by the participant.

Figure 2B:
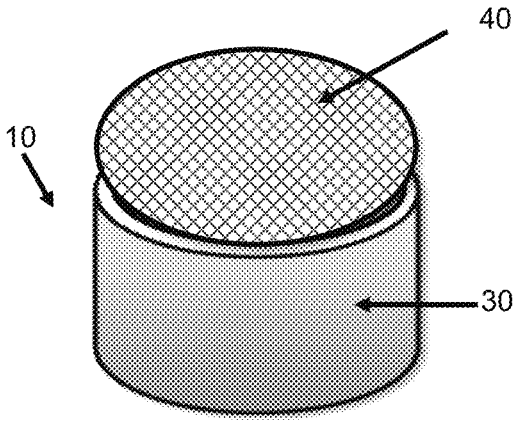
FIG. 2B is a top view of an exemplary embodiment of the golf ring training device in resting position while supporting a standard golf ball

FIG. 2B is a top view of an exemplary embodiment of the golf ring training device 10 in the resting position with a standard golf ball 40 seated on top of the golf ring training device 10. When a tilted into the stationary starting position by a driver club, the external cylindrical body surface 30 would appear as circular, as seen in FIG. 1B prior to follow through. A participant may then follow through by sweeping the ball and golf ring training device to target.

The golf ring training device 10 cylindrical body material composition is of a lightweight and resilient material of limited flexibility to enhance projectile characteristics while retaining a light character in flight, suitable for careful indoor use. The resilient material may be a polymer, carbon, rubber-type material capable of sliding over or under a clubface during use.

Figure 3A:
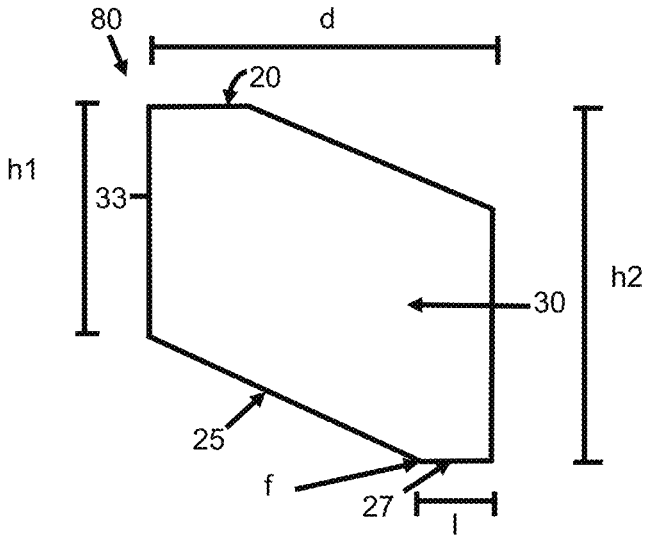
FIG. 3A is a side view of an alternative exemplary embodiment of the golf ring training device

FIG. 3A is a side view of an alternative exemplary embodiment of the golf ring training device 80. Alternative exemplary embodiment 80 consists of an external cylindrical body surface 30 with diameter d and a centrally located hollow internal cylindrical space of radius r as seen in FIG. 3C. The top surface 20 of the cylindrical body contains angular features in this embodiment. The external cylindrical body surface 30 and the hollow internal cylindrical space appear in an ellipsoid shape in the resting position and in a more circular shape when alternative exemplary embodiment 80 is tilted into a starting position. The training device at rest lays on surface 25 and tilts from pivot f toward the tilt surface 27 in the starting position. Cylindrical surface marked 33 receives the clubface during use. Length of surface 27 is described by I and may range from 0 to <1.3". The shortest cylindrical body height, h1, is the smallest distance parallel to the cylindrical body from the resting surface 25 to the top surface 20. The values of h1 may range from approximately half the size of a standard golf ball ~0.8" to 2". The longest cylindrical body height, h2, is the largest distance parallel to the cylindrical body from the tilt surface 27 to the top surface 20. The values of h2 may range from >h1 to <3".

Figure 3B:
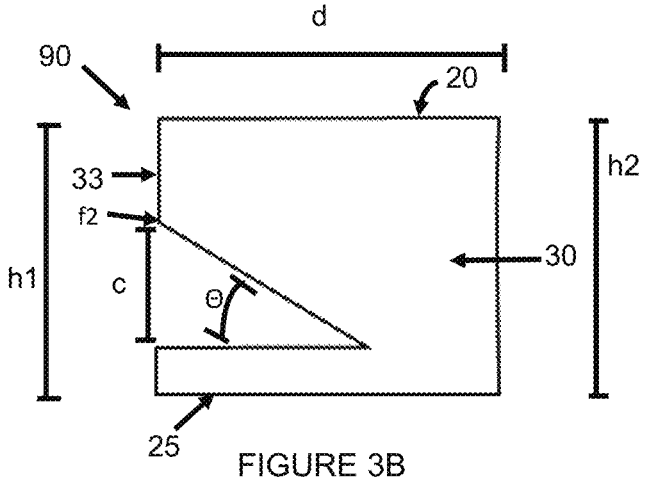
FIG. 3B is a side view of an alternative exemplary embodiment of the golf ring training device
Figure 3C:
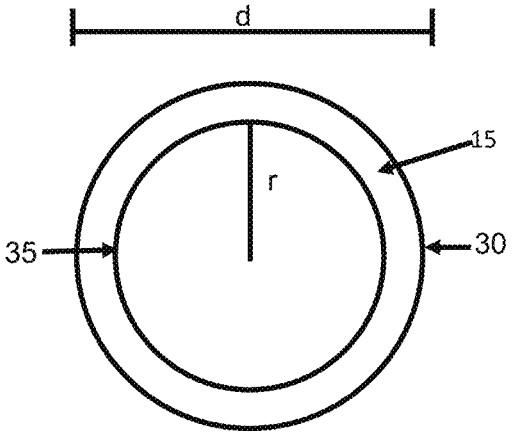
FIG. 3C is a top view of an alternative exemplary embodiment of the golf ring training device 3A and 3B when viewed in the starting position

FIG. 3B shows a side view of an alternative exemplary embodiment of the golf ring training device 90. A cylindrical cut-out angle Θ ranges from 8 to 45 degrees and creates cylindrical body space c, to allow clubface interaction at the pivot point f2 and contact surface 33. Cylindrical cut-out angle e converges inside the hollow internal cylindrical space. The contact surface 33 is located above the largest portion of cutout c in this alternative exemplary embodiment 90. Top surface is marked 20 and the external cylindrical body surface is marked 30. The device lays on rest surface 25 in the resting position. The shortest cylindrical body height, h1, is the smallest distance parallel to the cylindrical body from the resting surface 25 to the top surface 20. The values of h1 may range from approximately half the size of a standard golf ball ~0.8" to 1.7". The longest cylindrical body height, h2, is the largest distance parallel to the cylindrical body from the tilt surface 27 to the top surface and values of h2 may range from >=h1 to <3". External cylindrical body surface diameter is marked by d, with values ranging from 1.3 to 2.6". In this embodiment 90, the internal cylindrical hollow space of radius r (FIG. 3C) appears circular in the resting and starting positions, but appears ellipsoid during the follow through motion.

FIG. 3C is a top view of alternative exemplary embodiments of golf ring training devices 80 and 90. The solid portion of the cylindrical body 15 occurs between the parallel external cylindrical body surface 30 and the internal cylindrical body surface 35. External cylindrical body surface 30 and interior cylindrical body surface 35 from alternative exemplary embodiments 80 and 90 display their hollow internal cylindrical space in this view. External cylindrical body surface diameter is marked by d, with diameter values ranging from 1.3 to 2.6". Hollow internal cylindrical space has radius r, with values from d/2−0.125" and 0.375".

Figure 4A:
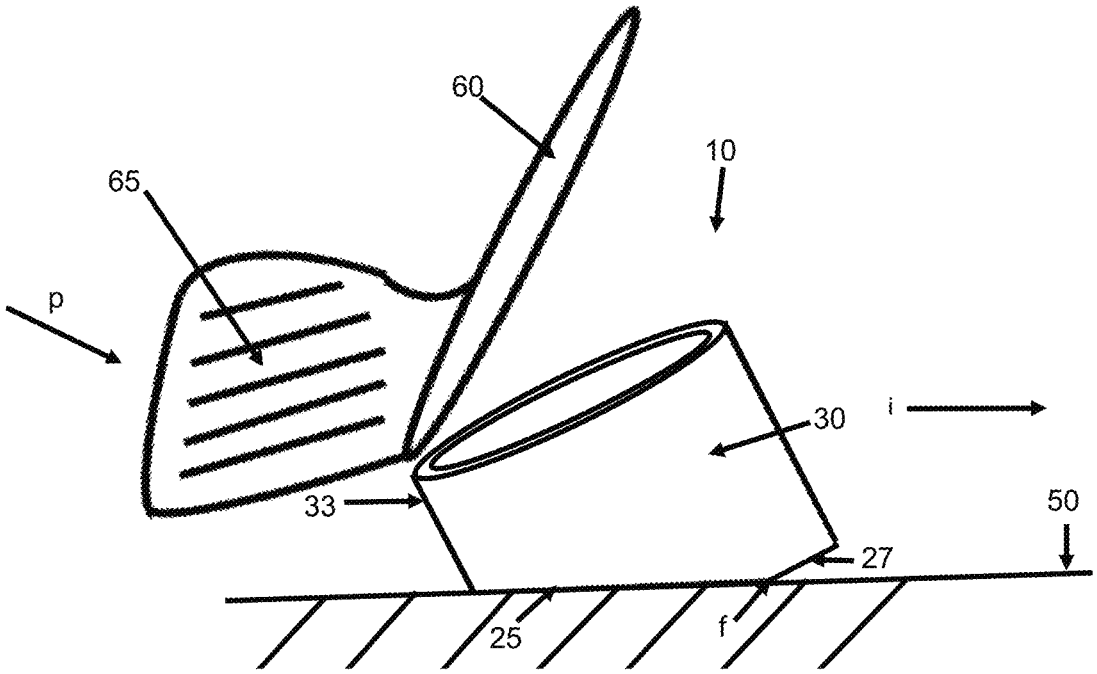
FIG. 4A is a perspective view of an exemplary embodiment of the golf ring training device in resting position while being prepared for use.

FIG. 4A shows a perspective view of the exemplary embodiment of golf ring training device 10 and club 60 being set up for use on an external operating surface 50. The operating surface 50 may be carpet, matting, or other surface which provides enough friction to the cylindrical body's pivot f and tilt 27 surfaces such that the training device 10 may pivot without rolling towards the cylindrical body's tilt surface 27. The participant has already prepared a target and surrounding area capable of accepting the training device manner without risking damage to themselves or surroundings. The device 10 was positioned such that the external cylindrical body surface 30 and contact surface 33 were angled away from the initial target direction i. The participant then slowly lowers their golf club along a downswing arc into an impact-type position with the clubface 65 hovering and the device stationary on its resting surface 25 and the external operating surface 50. A participant provides a slight target biased force p with the lofted clubface, thus automatically contacting the superior portion of the contact surface 33. This force p tilts the device 10 along pivot f, engaging the tilt surface 27 such that the external cylindrical body surface 30 and the hollow internal cylindrical space appear more circular, as viewed previously in FIG. 1B. Friction from the external operating surface 50 on the pivot f and tilt surfaces, along with a properly directed pushing force, allow the clubface and golf ring training device to remain balanced in the stationary starting position against gravity. The clubface 65 and golf ring training device 10 are now in the stationary starting position shown in FIG. 4B and are providing the participant immediate visual and tactile feedback on clubface position and orientation.

Figure 4B:
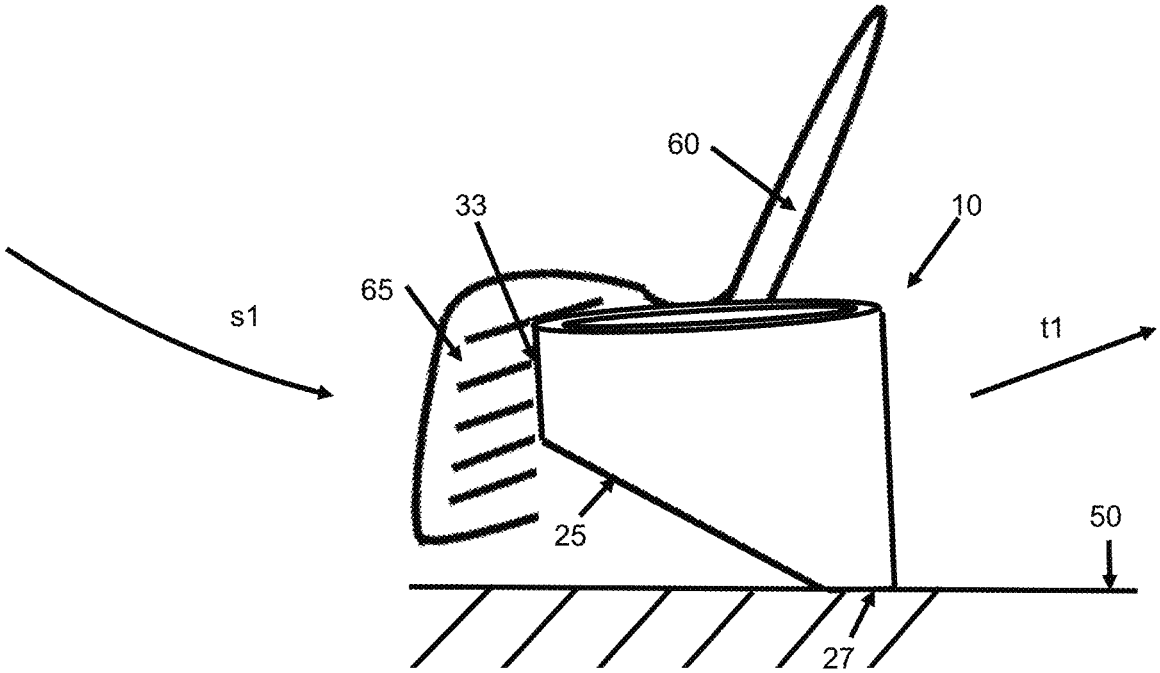
FIG. 4B is a perspective view of an exemplary embodiment of the golf ring training device in starting position and during the follow through motion.

FIG. 4B shows a perspective view of the golf ring training device 10 in starting position on its tilt surface 27 and the operating surface 50 as the follow through commences. The participant uses a golf club 60 to smoothly accelerate the training device 10 into an airborne projectile towards a clubface 65 dependent trajectory t1. From the starting position, the participant sweeps the clubface 65 and golf ring training device 10 toward the intended target in a diminishing downward angle of attack or arc s1 relative to the operating surface 50. Maintaining or slightly decreasing the effect loft of the clubface 65 relative to their angle of attack or arc s1 while in contact with the contact 33 or resting surface 25 sends the device into a deliberate airborne trajectory t1 toward the target without tumbling in the air. Thus, the golf ring training device 10 limits provides feedback on projectile distance and accuracy based on a participant's dynamic clubface control with the angled features of the training device's cylindrical body surfaces such that the training device 10 becomes an airborne projectile without tumbling. This is a novel device construction and method of use which is not readily apparent, and which is lacking from existing patents cited of non-standard sport projectiles.

Figure 5A:
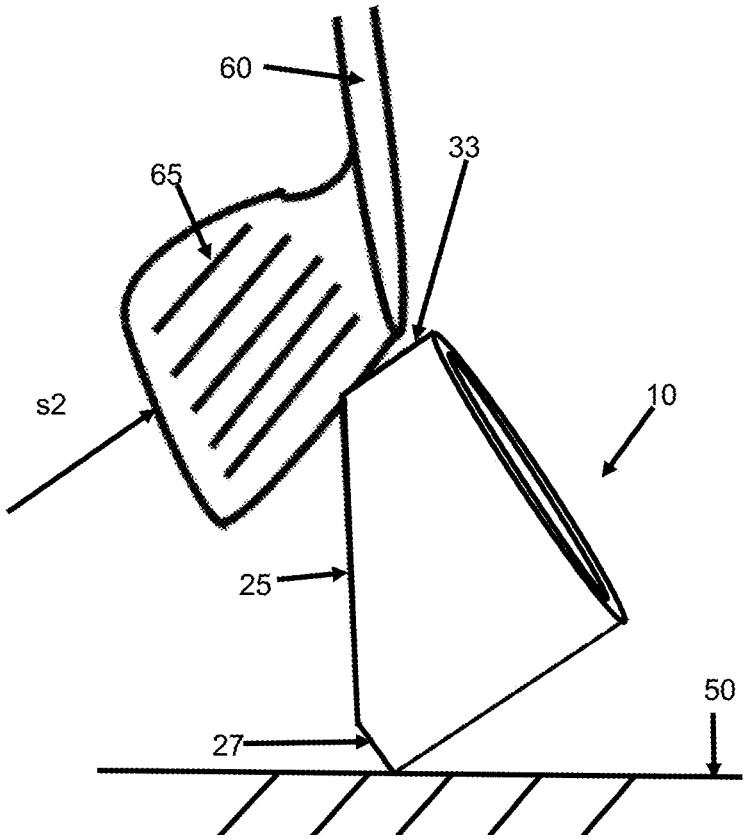
FIG. 5A is a perspective view of an exemplary embodiment of the golf ring training device and method during the follow through motion, with an excessively ascending clubface angle of attack

FIG. 5A shows a perspective view of the golf ring training device 10 sliding under the golf club 60 due to an excessively ascending clubface 65 angle of attack s2. The excessively ascending angle of attack s2 slides the clubface 65 beyond the contact surface 33 and the resting surface 25. This causes the training device 10 to pivot past the tilt surface 27 on the operating surface 50, creating a tumbling event with limited control of trajectory, distance and accuracy.

Figure 5B:
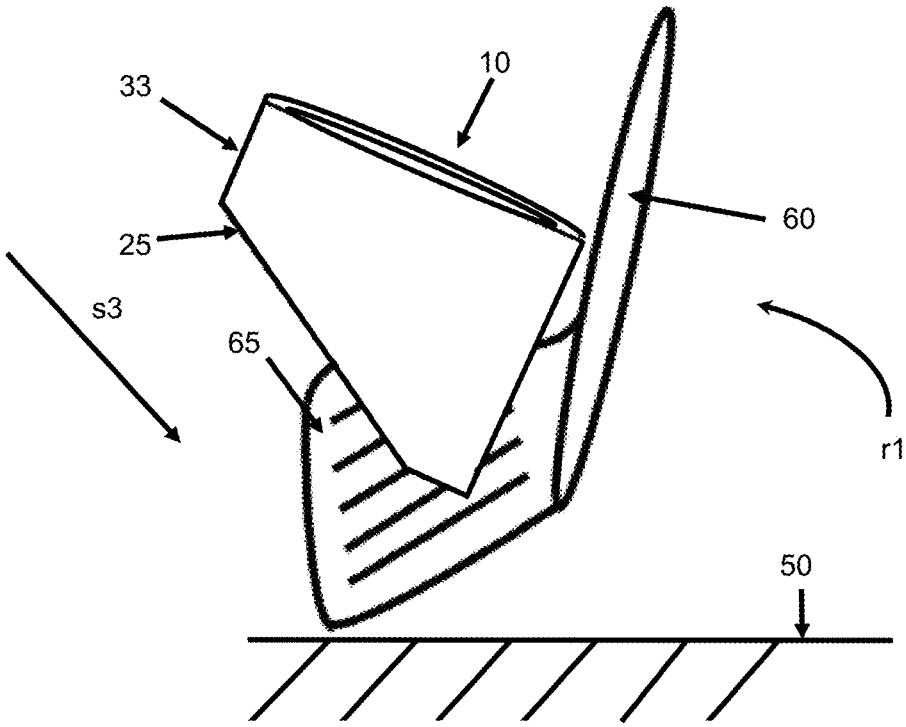
FIG. 5B is a perspective view of an exemplary embodiment of the golf ring training device and method during the follow through motion, with an excessively descending clubface angle of attack

FIG. 5B shows a perspective view of the golf ring training device 10 rising r1 over the golf club 60 due to an excessively descending clubface 65 angle of attack s3 or effective increase in clubface 65 loft during interaction with the contact 33 or rest 25 surfaces. This causes the training device 10 to rise r1 over the clubface 65 without acquiring enough linear momentum to reach the target without tumbling or touching the operating surface 50 first.

In an alternative exemplary embodiment of golf ring training device 90 in FIG. 3B, the cylindrical cut out space c allows a similar method of clubface use to the exemplary embodiment of training device 10, but on an external operating surface offering less friction. In the resting position, the hollow internal cylindrical space of training device 90 appears circular from above. A participant interfaces the clubface to the cylindrical cutout space c of FIG. 3B without touching the contact surface 33 first to attain the starting position. A participant may then use their clubface in a target-biased arc to propel the golf ring training device in the air to target without tumbling. During the follow through motion, the cylindrical body surfaces will appear slightly ellipsoid during the follow through motion.

The golf ring training device utilizes angled features integrated into the cylindrical body to create at least one pivot point between the external operating surface and the device's body. The pivot point of the cylindrical body occurs closer to the target-side, such that in the resting position on an operating surface, gravity pulls the cylindrical body into the resting position. When a clubface angles the cylindrical body into a starting position, these features provide immediate feedback to a participant based on visual, tactile, and performance means as the clubface remains in the stationary starting position and later as motion commences during the follow through. In preparation for use, the participant picks an appropriate target and safe surrounding area such that an errant attempt will cause no damage to themselves or their surroundings and angles the cylindrical body away from the target. The external cylindrical body surface located furthest from the target inherently contains an intended contact surface for golf clubface interaction near or below what would otherwise be the center of a standard golf ball. The clubface may interact with the contact and potentially inferior resting surfaces of the training device based on clubface loft and dynamic clubface follow through control. Dynamically maximizing the clubface and contact surface or resting surface congruency tends to efficiently increase linear momentum of the training device to target along a deliberate trajectory normal to the clubface. Thus, the golf ring training device becomes an airborne projectile without tumbling characteristics.

As previously described, use of the golf ring training device provides a method by which a participant may practice a stationary golf impact position and clubface control during the follow through motion to a target. Clubface angles from short iron clubs through the hybrids tend to perform as described in the exemplary embodiments, with the cylindrical hollow space oriented in a somewhat vertical to oblique angle throughout projectile motion into a defined target. Practice may occur independently such that the participant picks an appropriate target, orients the training device on an operating surface in the resting position, pivots the device with clubface into the stationary starting position, makes a sweeping follow-through motion of the clubface and training device toward a target, and receives feedback based on training device behavior. Practice in the same method may also occur in a group game setting, such that participants take turns and are awarded points based on reaching the target in an airborne and non-tumbling method as described, with or without varying locations, obstacles, or other safe confinements.

The invention claimed is:

1. A golf ring training device which provides an immediate feedback about a participant's clubface control when in a stationary starting position and during a follow through motion toward a target; wherein the golf ring training device comprises:

A device having a top consisting essentially of a flat surface, a bottom opposite the top which angles the device away from the target, a flat reset surface portion of the bottom surface on which the training device lays, a flat tilt surface portion of the bottom surface adjacent to the rest surface; the bottom surface consisting essentially of the interface between the rest surface and the tilt surface to create at least one pivot point about which the training device pivots; the least one pivot point occurs on an axis perpendicular to the intended target and occurs nearer the target such that the device lays on the rest surface when set on an external operating surface; said device constructed of a hollow cylindrical body with a centrically located hollow internal cylindrical space separating the top and bottom; the hollow cylindrical body consisting essentially of an external cylindrical body surface diameter and a parallel internal cylindrical body surface diameter; said internal cylindrical body surface diameter occurring in conjunction with said centrically located hollow internal cylindrical space radius; said hollow cylindrical body having height between the top and bottom; said external cylindrical body surface located furthest from the target is the point of a shortest cylindrical body height between the top and rest surface; said shortest cylindrical body height occurs at approximately ½ the height of a standard golf ball to less than two inches; said hollow cylindrical body having a longest cylindrical body height between the top and tilt surface which is greater than the shortest cylindrical body height but less than three inches; said hollow cylindrical body being a solid cylindrical body between the external cylindrical body surface and the internal cylindrical body surface; said solid cylindrical body made of a material composition that allows the cylindrical body to slide over or under the clubface during the follow through motion;

said bottom surface of the cylindrical body, when placed on the external operating surface, inherently tilts onto the rest surface, thus angling the cylindrical body and hollow internal cylindrical space away from the target into a resting position; said resting position creates an ellipsoid-type appearance of the cylindrical body and hollow internal cylindrical space when viewed from above; said resting position designates the external cylindrical body surface located furthest from the target as a contact surface for clubface interaction near or below the center of the standard golf ball; said clubface interaction with the contact surface requires a slight target-biased pushing force to tilt the cylindrical body and hollow internal cylindrical space by way of the least one pivot into a more circular appearance when viewed from above; said more circular appearance of the hollow internal cylindrical space creates a stationary starting position;

said stationary starting position provides the participant feedback of the slight target-biased clubface force to remain balanced in the stationary starting position; said stationary starting position engages the tilt surface and the least one pivot on the external operating surface when the participant accelerates the clubface interaction during the follow through motion; said follow through motion efficiently sends the training device into a deliberate airborne projectile trajectory without tumbling characteristics through dynamically maximizing the clubface and the contact or the resting surface congruency.

2. The golf ring training device of claim 1, wherein the shortest cylindrical body height is approximately ½ height of a standard golf ball (~0.8") to 2" and the longest cylindrical body height is <3".

3. The golf ring training device of claim 1, wherein the diameter of the external cylindrical body surface is between 1.3" to 2.6" and the internal cylindrical body surface diameter ranges between the external cylindrical surface diameter minus 0.25" and 0.75".

4. The golf ring training device of claim 1, wherein the cylindrical body material composition is made of a resilient polymer, carbon, or rubber-type material.

5. The golf ring training device of claim 1, wherein the cylindrical body material composition is made of a slightly flexible polymer, carbon, or rubber-type material.

6. The golf ring training device of claim 1, wherein a golf or other training ball is placed on top of the hollow internal cylindrical space of the device.

7. The golf ring training device which provides an immediate feedback about a participant's clubface control when in a stationary starting position and during a follow through motion toward a target; wherein the golf ring training device comprises:

A device having a top consisting essentially of a flat surface, a bottom opposite the top which angles the device away from the target, a flat reset surface portion of the bottom surface on which the training device lays, a flat tilt surface portion of the bottom surface adjacent to the rest surface; the bottom surface consisting essentially of the interface between the rest surface and the tilt surface to create at least one pivot point about which the training device pivots; the least one pivot point occurs on an axis perpendicular to the intended target and occurs nearer the target such that the device lays on the rest surface when set on an external operating surface; said device constructed of a hollow cylindrical body with a centrically located hollow internal cylindrical space separating the top and bottom; the hollow cylindrical body consisting essentially of an external cylindrical body surface diameter and a parallel internal cylindrical body surface diameter; said internal cylindrical body surface diameter occurring in conjunction with said centrically located hollow internal cylindrical space radius; said hollow cylindrical body having height between the top and bottom; said external cylindrical body surface located furthest from the target is the point of a shortest cylindrical body height between the top and rest surface; said shortest cylindrical body height occurs at approximately ½ the height of a standard golf ball to less than 1.7 inches; said hollow cylindrical body having a longest cylindrical body height between the top and tilt surface which is greater than or equal to the shortest cylindrical body height but less than three inches; said hollow cylindrical body having an angled cutout theta into said hollow internal cylindrical space; said cylindrical cut-out angle converges at a point inside the hollow internal cylindrical space; said angled cutout creates a cylindrical body space, said cylindrical body space creates a pivot point with the external cylindrical body surface to allow clubface interaction, said cylindrical body space having an upper surface which is also a contact surface for clubface interaction;

said hollow cylindrical body being a solid cylindrical body between the external cylindrical body surface and the internal cylindrical body surface; said solid cylindrical body made of a material composition that allows the cylindrical body to slide over or under the clubface during the follow through motion;

said hollow internal cylindrical space appears in a circular-type shape when viewed from above when laying on the rest surface, thus creating a resting position; said hollow internal cylindrical space appears in a more ellipsoid-type shape when viewed from above during the follow through motion.

8. The golf ring training device of claim 7, wherein the shortest cylindrical body height is approximately one half the height of a standard golf ball ~0.8" to 1.7" and the longest cylindrical body height is <3".

9. The golf ring training device of claim 7 wherein the diameter of the external cylindrical body surface is between 1.3" to 2.6" and the hollow internal cylindrical space radius ranges between the external cylindrical body surface diameter/2 minus 0.125" and 0.375".

10. The golf ring training device of claim 7, wherein the cylindrical body material composition is made of a resilient polymer, carbon, or rubber-type material.

11. The golf ring training device of claim 7, wherein the cylindrical body material composition is made of a resilient and slightly flexible polymer, carbon, or rubber-type material.

12. The golf ring training device of claim 7, wherein the cylindrical cut-out angle theta ranges from 8 to 45 degrees.

13. The golf ring training device of claim 7, wherein a golf or other training ball is placed inside the hollow internal cylindrical space.

14. The golf ring training device of claim 7, wherein a golf or other training ball is placed on top of the hollow internal cylindrical space of the device.

15. A golf ring training device and method utilizing an initially stationary golf clubface to provide a participant feedback on the clubface starting position and follow-through motion toward an appropriate target and safe surrounding area; the golf ring training device and method comprises:

designating the appropriate target and safe surrounding area such that an errant attempt will cause no damage to themselves or their surroundings;

providing a hollow, angled-cylindrical ring-shaped training device; said training device having a solid portion of a cylindrical body between an external cylindrical body surface and a parallel internal cylindrical body surface; said internal cylindrical body surface occurs in conjunction with a hollow internal cylindrical space; the cylindrical body having height between a top surface and an angled bottom surface; said bottom surface consisting essentially of a rest surface, at least one pivot, and a tilt surface; said least one pivot point occurs on an axis perpendicular to the target and occurs nearer the target such that the training device lays away from the target when set on an external operating surface; said device positioned away from the target on an external operating surface creates a resting position for the training device; said resting position creates an ellipsoid-type appearance of the hollow internal cylindrical space when viewed from above; said resting position angles the external cylindrical body surface located furthest from the target into position as a contact surface for the clubface; said external cylindrical body surface located furthest from the target also being the point of a shortest cylindrical body height between the top and rest surface; said shortest cylindrical body height occurs at approximately one half the height of a standard golf ball to less than two inches; said cylindrical body having a longest cylindrical body height between the top and tilt surface which is greater than the shortest cylindrical body height but less than three inches;

tilting the training device on the contact surface with a golf clubface from the resting position by way of the least one pivot engages the tilt surface to create a stationary starting position; the stationary starting position creates a more circular appearance of the hollow internal cylindrical space when viewed from above, thus providing the participant feedback;

accelerating the training device from the stationary starting position into an airborne projectile without tumbling characteristics; said airborne projectile reaching the intended target without touching the external operating surface, thus providing the participant feedback;

providing the participant feedback of the clubface occurs from the stationary starting position, the airborne projectile without tumbling characteristics, and the training device reaching the intended target without touching the external operating surface first.

16. Method of claim 15, wherein the golf ring training device rolls under the clubface.

17. Method of claim 15, wherein the golf ring training device rolls over the clubface.

18. Method of claim 15, wherein the golf ring training device is used independently.

19. Method of claim 15, wherein the golf ring training device is used in a group game setting.

* * * * *